US009157683B2

(12) United States Patent
Doe et al.

(10) Patent No.: US 9,157,683 B2
(45) Date of Patent: Oct. 13, 2015

(54) HEAT EXCHANGER FOR AIRCRAFT APPLICATION

(71) Applicant: HAMILTON SUNDSTRAND CORPORATION, Windsor Locks, CT (US)

(72) Inventors: Michael Doe, Southwick, MA (US); Brian R. Shea, Windsor, CT (US); Kurt L. Stephens, Enfield, CT (US); Matthew William Miller, Enfield, CT (US); Michael Zager, Windsor, CT (US); Irving C. Ostrander, Springfield, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 283 days.

(21) Appl. No.: 13/854,999

(22) Filed: Apr. 2, 2013

(65) Prior Publication Data

US 2014/0293540 A1 Oct. 2, 2014

(51) Int. Cl.
*H05K 7/20* (2006.01)
*F28B 1/00* (2006.01)

(52) U.S. Cl.
CPC ..... *F28B 1/00* (2013.01)

(58) Field of Classification Search
CPC .... F28B 1/00; H05K 7/1412; H05K 7/20136; H05K 7/20218
USPC ..... 165/172, 80.1–80.5, 104.11–104.34; 361/679.46–679.54, 688–723
See application file for complete search history.

(56) References Cited

U.S. PATENT DOCUMENTS

| | | | | |
|---|---|---|---|---|
| 5,353,639 | A | 10/1994 | Brookins et al. | |
| 5,934,366 | A | 8/1999 | Gowan | |
| 5,941,303 | A * | 8/1999 | Gowan et al. | 165/176 |
| 6,056,047 | A | 5/2000 | Gowan | |
| 6,145,589 | A | 11/2000 | Gowan | |
| 6,830,100 | B2 | 12/2004 | Gowan et al. | |
| 6,942,183 | B2 | 9/2005 | Zywiak | |
| 7,353,864 | B2 | 4/2008 | Zaffetti et al. | |
| 7,946,337 | B2 | 5/2011 | Birbara et al. | |
| 8,300,412 | B2 | 10/2012 | Pal | |
| 2008/0087039 | A1 * | 4/2008 | Reed et al. | 62/498 |
| 2011/0302928 | A1 * | 12/2011 | Mudawar | 60/782 |
| 2012/0011867 | A1 * | 1/2012 | Koons et al. | 62/115 |

* cited by examiner

*Primary Examiner* — Anthony Haughton
*Assistant Examiner* — Yahya Ahmad
(74) *Attorney, Agent, or Firm* — Carlson, Gaskey & Olds, PC

(57) ABSTRACT

A heat exchanger includes a plurality of mini-channel tubes. The mini-channel tubes extends for an axial length defined between two manifolds. The mini-channel tubes include a plurality of generally rectangular flow passages. The generally rectangular flow passages are aligned adjacent to each other to define a lateral dimension. A first lateral width of the generally rectangular passages is defined with a ratio of the axial length to the first lateral width being between 201.3 and 215.3. An aircraft system is also disclosed.

20 Claims, 2 Drawing Sheets

HEAT EXCHANGER FOR AIRCRAFT APPLICATION

BACKGROUND

This application relates to a heat exchanger having mini-channel tubes.

Heat exchangers are known and utilized in any number of applications. One application that requires a number of heat exchangers is an aircraft.

One known heat exchanger for use on aircraft applications includes two cooling circuits. A first cooling circuit contains a warm fluid which is sourced from a power electronics component for cooling the component. A second cooling circuit contains a warm fluid which is sourced from a power electronics component for cooling the component. The third circuit utilizes a cool air source such as lavatory/galley discharge air to overboard.

A heat exchanger may be formed of a plurality of very small channels known as "mini-channels" which move a fluid between opposed ends for the first circuit fluid. Air supplied from the third circuit passes over the mini-channel tubes.

SUMMARY

In one exemplary embodiment, a heat exchanger includes a manifold for receiving a fluid to be cooled and for returning the fluid to be cooled to a system to be cooled. The manifold communicates with passages in a plurality of mini-channel tubes. Fluid can enter the manifold through an inlet and pass axially through a first layer of the mini-channel tubes. When the fluid reaches the manifold, it is returned axially through a second layer of the mini-channel tubes to the next pass of the manifold, and finally to communicate with an outlet. Each layer includes a plurality of mini-channel tubes, including an axial length defined between the opposing manifolds. The mini-channel tubes include a plurality of generally rectangular flow passages. The generally rectangular flow passages are aligned adjacent to each other to define a lateral dimension. A first lateral width of the generally rectangular passages is defined with a ratio of the axial length to the first lateral width being between 201.3 and 215.3. An aircraft system is also disclosed.

These and other features may be best understood from the following drawings and specification.

DETAILED DESCRIPTION

Figure 1A:
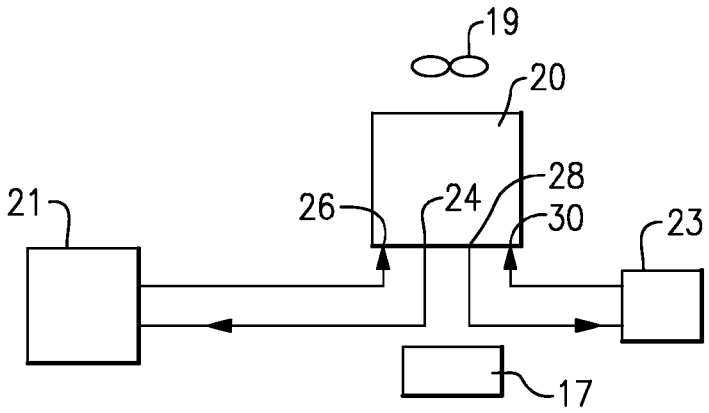
FIG. 1A schematically shows a heat exchanger.

A heat exchanger 20 is incorporated into an aircraft and has a first fluid circuit with an outlet 24 delivering a cooling fluid to a power electronics component 21 and receiving the fluid which has cooled the power electronics at an inlet 26. The cooling fluid is circulated to and from the power electronics component 21 and is cooled across the heat exchanger 20.

A second power electronics component 23 receives cooling fluid from an outlet 28 in heat exchanger 20, and the cooling fluid returns to the heat exchanger 20 through an inlet 30. A RAM air fan 19 drives cooling air from the third circuit over the heat exchanger 20 to cool the fluids in the two circuits within the heat exchanger 20. The ram air fan 19 may draw cooling air from a restroom or galley 17. That air is then delivered outwardly of the aircraft. Although the fan 19 is shown downstream of the heat exchanger 20, it may also be located upstream.

Figure 1B:
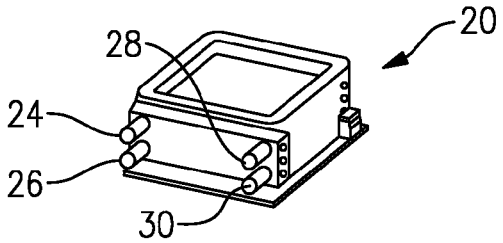
FIG. 1B shows a view of the heat exchanger.

FIG. 1B shows the inlet 26, outlet 24, inlet 30, and outlet 28 associated with the core of the heat exchanger 20. The cooling liquid circulated through the two circuits may be appropriate fluid. In one component, a 60/40 mixture of propylene glycol and water may be used.

Figure 1C:
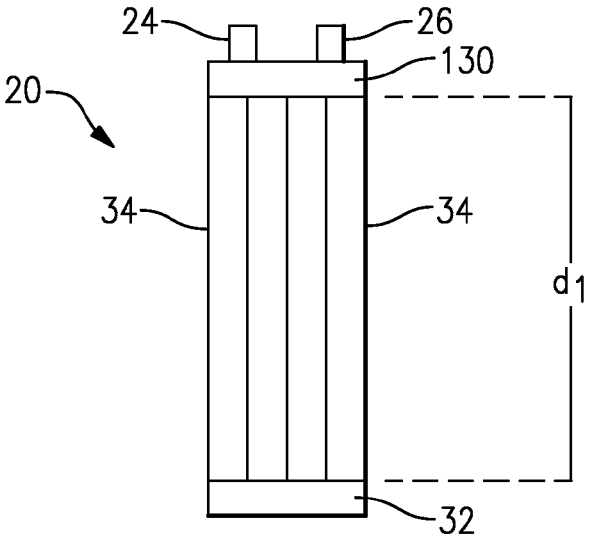
FIG. 1C schematically shows one portion of the heat exchanger.

FIG. 1C schematically shows that the heat exchanger 20 has a core, including a plurality of mini-channels tubes 34 extending between a manifold 32 at one axial end and a manifold 130. Fluid flows from the inlet 26 axially downwardly as shown in FIG. 1C to the manifold 32, and then returns through another of the mini-channel tubes 34 back to the manifold 130, and outwardly of the outlet 24.

The mini-channel tubes 34 extend for an axial length $d_1$. In one embodiment, the axial length $d_1$ was 9.0 inch (22.9 centimeters). In the disclosed embodiment, there are four of the mini-channel tubes 34 spaced along a width of the heat exchanger, defined perpendicularly to a flow direction through the mini-channel tubes 34.

Figure 2:
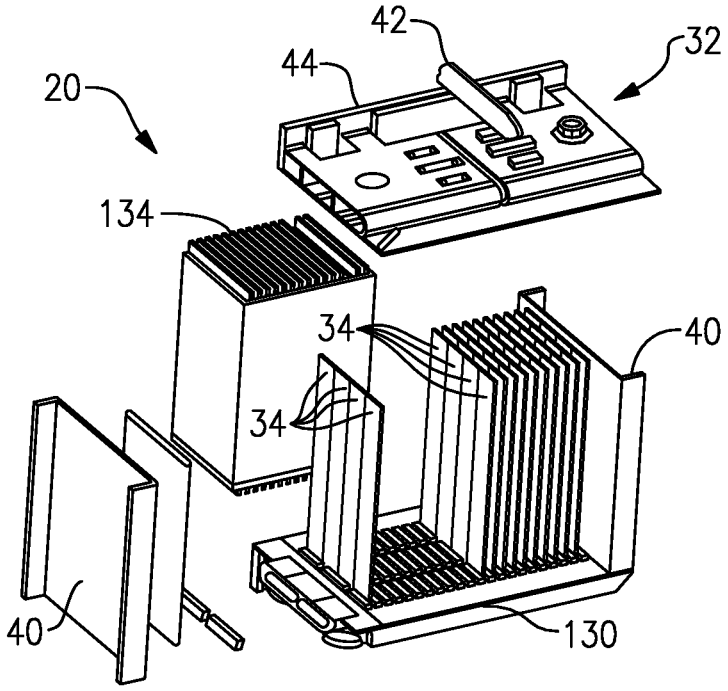
FIG. 2 is an exploded view of the heat exchanger.

As shown in FIG. 2, the heat exchanger 20 includes the manifold 32 having a baffle divider 42 to divide between two channels for cooling the power electronics components 21 and 23. Fluid passages within the manifold 32 direct the fluid as can be appreciated from FIG. 1C. As shown, a core 134 includes a plurality of sets of four of the mini-channel tubes 34. The sets of four mini-channel tubes can be called a layer. There are fourteen layers in each fluid circuit, in one embodiment. End plates 40 are positioned at each end of the core 134. All of the components mentioned typically are formed of an aluminum and are all brazed together to form the final heat exchanger 20.

Figure 3:
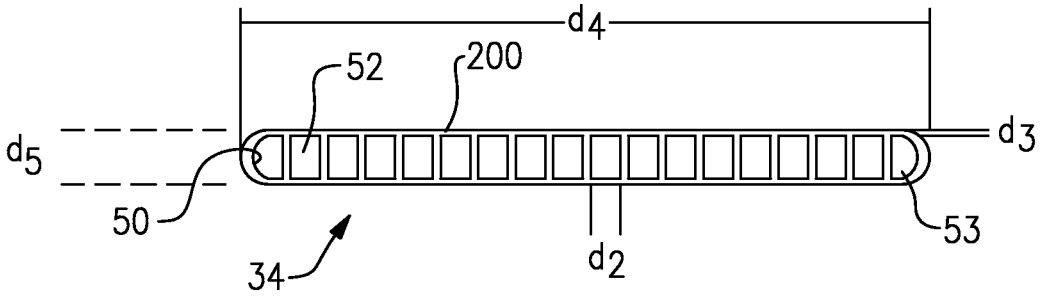
FIG. 3 shows a heat exchanger tube.

As shown in FIG. 3, the mini-channel tubes 34 include a plurality of passages 52, which are generally rectangular, and end passages 53, which have curved outer lateral walls 50. It should be understood that passages 52 need not be true rectangles, but are simply closer to a rectangular shape than are end passages 53. The lateral width of each of the passages 52 is defined by $d_2$. In one embodiment $d_2$ was 0.0433 inch (0.109982 centimeter). A wall thickness $d_3$ in the same embodiment is 0.010 inch in one embodiment (0.0254 centimeter). The wall thickness is defined between an outer surface of the generally rectangular passages 52 and an outer wall 200.

A height $d_5$ of the mini-channel tube 34 was 0.082 inch (0.20828 centimeter) in one embodiment. The height is defined perpendicular to the lateral dimension. An overall lateral length $d_4$ was 1.00 inch (2.54 centimeter) in the same embodiment. In one embodiment, there were sixteen of the rectangular passages 52 and then two outer passages 53 having the curved laterally outer walls 50.

In embodiments, a ratio of $d_1$ to $d_2$ was between 201.3 and 215.3; a ratio of $d_2$ to $d_3$ was between 3.896 and 4.918; a ratio of $d_1$ to $d_4$ was between 8.993 and 9.027; a ratio of $d_4$ to $d_5$ was between 12.01 and 12.39; and a ratio of $d_5$ to $d_3$ was between 7.261 and 9.471.

A heat exchanger 20 formed with plural mini-channel tubes 34 having the defined dimensions provides very efficient heat transfer compared to the prior art.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A heat exchanger comprising:

a manifold for receiving a fluid to be cooled and for returning the fluid to be cooled to a system to be cooled;

said manifold communicating with passages in a plurality of mini-channel tubes, and a manifold at an opposed end of said mini-channel tubes, such that fluid can enter said manifold through an inlet, pass axially through a first pass of said mini-channel tubes which is composed of two tubes in parallel per layer, reach said manifold, and be returned axially through a second pass of said mini-channel tubes to said manifold, and to communicate with an outlet; and said plurality of mini-channel tubes, including an axial length defined between said manifold and said manifold, and said mini-channel tubes, including a plurality of generally rectangular flow passages, said generally rectangular flow passages being aligned adjacent to each other to define a lateral dimension and a first lateral width of said generally rectangular passages being defined, with a ratio of said axial length to said first lateral width being between 201.3 and 215.3.

2. The heat exchanger as set forth in claim 1, wherein there is a laterally outward passage having a generally curved laterally outer wall at each lateral end of said plurality of generally rectangular flow passages.

3. The heat exchanger as set forth in claim 1, wherein said mini-channel tubes also having a height defined perpendicular to said lateral direction, and a thickness of a wall of said mini-channel tube between an outer surface of said generally rectangular passages, and an outer wall of said mini-channel tubes defined, with a ratio of said height to said thickness of said wall being between 7.261 and 9.471.

4. The heat exchanger as set forth in claim 3, wherein a laterally outer dimension of said mini-channel tubes being defined, and a ratio of said axial length to said laterally outer dimension being between 8.993 and 9.027.

5. The heat exchanger as set forth in claim 4, wherein a ratio of said first lateral width to said wall thickness being between 3.896 and 4.918.

6. The heat exchanger as set forth in claim 5, wherein a ratio of said laterally outer dimension of said mini-channel tubes to said height being between 12.01 and 12.39.

7. The heat exchanger as set forth in claim 6, wherein said mini-channel tubes are arranged in sets of four in each said layer.

8. The heat exchanger as set forth in claim 7, wherein there are 12 layers of said sets of four mini-channel tubes.

9. The heat exchanger as set forth in claim 1, wherein said mini-channel tubes are arranged in sets of four in each said layer.

10. The heat exchanger as set forth in claim 1, wherein there are two fluid circuits within said heat exchanger, and there being a baffle divider wall within said manifold which separates the heat exchanger into said two fluid flows.

11. An aircraft system comprising:

a first power electronics component circuit;

a second power electronics component circuit;

an air circuit;

a heat exchanger for circulating a cooling fluid to both said power electronics components and including a manifold for receiving a fluid to be cooled and for returning the fluid to the power electronics components;

said manifold communicating with passages in a plurality of mini-channel tubes, and a manifold at an opposed end of said mini-channel tubes, such that fluid can enter one of said manifolds through a pair of inlets, pass axially through a layer of said mini-channel tubes, reach the other said manifold, and be returned axially through a layer of said mini-channel tubes to said one of said manifold, and to communicate with a pair of outlets;

said plurality of mini-channel tubes, including an axial length defined between said manifolds, and said mini-channel tubes, including a plurality of generally rectangular flow passages, said generally rectangular flow passages being aligned adjacent to each other to define a lateral dimension and a first lateral width of said generally rectangular passages being defined, with a ratio of said axial length to said first lateral width being between 201.3 and 215.3; and a fan for delivering an air source over said heat exchanger, with the air source being at least one of a restroom or galley on an aircraft.

12. The aircraft system as set forth in claim 11, wherein there is a laterally outward passage having a generally curved laterally outer wall at each lateral end of said plurality of generally rectangular flow passages.

13. The aircraft system as set forth in claim 11, wherein said mini-channel tubes also having a height defined perpendicular to said lateral direction, and a thickness of a wall of said mini-channel tube between an outer surface of said generally rectangular passages, and an outer wall of said mini-channel tubes defined, with a ratio of said height of said generally rectangular passages to said thickness of said wall being between 7.261 and 9.471.

14. The aircraft system as set forth in claim 13, wherein a laterally outer dimension of said mini-channel tubes being defined, and a ratio of said axial length to said laterally outer dimension being between 8.993 and 9.027.

15. The aircraft system as set forth in claim 14, wherein a ratio of said first lateral width to said wall thickness being between 3.896 and 4.918.

16. The aircraft system as set forth in claim 15, wherein a ratio of said laterally outer dimension of said mini-channel tubes to said height being between 12.01 and 12.39.

17. The aircraft system as set forth in claim 16, wherein said mini-channel tubes are arranged in sets of four in each said layer.

18. The aircraft system as set forth in claim 17, wherein there are 12 layers of said sets of four mini-channel tubes.

19. The aircraft system as set forth in claim 11, wherein said mini-channel tubes are arranged in sets of four in each said layer.

20. The aircraft system as set forth in claim 11, wherein there is a baffle divider in said other manifold to separate fluid into separate fluid circuits associated with cooling each of said power electronics components.

* * * * *